United States Patent [19]

Gauthier

[11] 4,297,954

[45] Nov. 3, 1981

[54] APPARATUS FOR ATTACHING SLIDE FASTENER ELEMENTS TO FABRIC

[75] Inventor: Henry J. Gauthier, Naugatuck, Conn.

[73] Assignee: Scovill Inc., Waterbury, Conn.

[21] Appl. No.: 148,582

[22] Filed: May 9, 1980

Related U.S. Application Data

[63] Continuation of Ser. No. 43,443, May 29, 1979, abandoned.

[51] Int. Cl.[3] ..... D05B 3/12

[52] U.S. Cl. ..... 112/104

[58] Field of Search ..... 112/104, 105, 113, 106

[56] References Cited

U.S. PATENT DOCUMENTS 3,244,129 4/1966 Stingruebner ..... 112/104 X 3,755,879 9/1973 Cuckson ..... 112/105 X 4,006,695 2/1977 Van Amburg ..... 112/104

4,169,421 10/1979 Foults ..... 112/104

*Primary Examiner*—H. Hampton Hunter

*Attorney, Agent, or Firm*—Dallett Hoopes

[57] ABSTRACT

Sewing machine is modified to include means for feeding and cutting off slide fastener ladder as it is sewn directly to fabric. The means for feeding and cutting off include a pair of parallel blades one of which, the feed blade, is loosely mounted and biased downwardly so that when the assembly is depressed all the way forward, blade yields and cutter severs the ladder. Cam means are provided to drive the assembly in a rectangular path to engage the ladder element-by-element, pulling it through the sewing station. Override means are provided to momentarily stop the back-and-forth movement of the assembly and a depressor simultaneously urges the assembly down to accomplish the aforesaid severing.

14 Claims, 23 Drawing Figures

APPARATUS FOR ATTACHING SLIDE FASTENER ELEMENTS TO FABRIC

This is a Continuation of application Ser. No. 043,443, filed May 29, 1979 and now abandoned.

BACKGROUND OF THE INVENTION

1. Field of the Invention

This invention relates to apparatus for attaching slide fastener elements directly to the fabric of a garment or the like. More specifically, the invention relates to a sewing machine attachment or modification adapted to stitch uniformly spaced slide fastener elements directly to fabric without an intervening tape. The invention may be regarded as an improvement over the apparatus for the same purpose disclosed in U.S. Ser. No. 921,745, filed by Jonathan Foults on July 3, 1978, now U.S. Pat. No. 4,169,421, issued Oct. 2, 1979.

2. Description of the Prior Art

In the above-identified specification there was disclosed an apparatus for sewing U-shaped slide fastener elements directly to the fabric of a garment or the like. While the apparatus described in that disclosure is meritorious and desirable in every way, the present invention relates to an advancement, or an improvement, on the Foults apparatus.

SUMMARY OF THE INVENTION

Briefly, the apparatus of the present invention includes a sewing machine and attachment therefor adapted, as was the earlier device, to not only feed lines of slide fastener elements through the sewing machine so that they may be sewn directly to the fabric, but also means for severing the line of elements after a predetermined length of line. The present invention includes a positively driven and reliable attachment including cam means adapted to drive a follower to oscillate the feed means. Override means are provided for the cam to stop the oscillation of the feed means during a cutting process in which the feed means is depressed and the line of elements is severed.

Additionally, means may be provided by which the automatic operation of the machine may be effected so that the length of the zipper to be sewn may be set and its sewing attachment to the fabric may be effected including anchoring stitches at either end of the line of fastener elements.

BRIEF DESCRIPTION OF THE DRAWINGS

Other features of the invention will be apparent from a study of the accompanying specification including the attached drawings, all of which disclose non-limiting embodiments of the invention. In the drawings.

FIG. A is an enlarged view transverse of a line of fasteners with which the invention is adapted to be used.

Figure 8A:
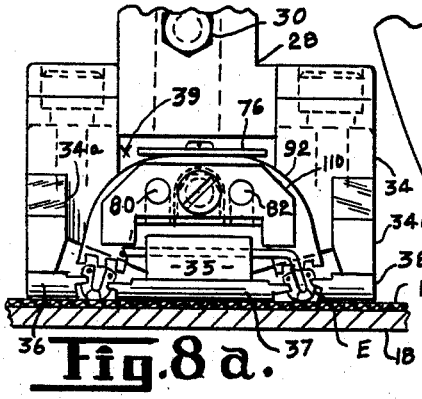
FIG. 8 is an enlarged fragmentary sectional view taken on the line 8—8 of FIG. 4 with a portion of the feed and cutter assembly and presser foot broken away to show interior construction.
Figure 8:
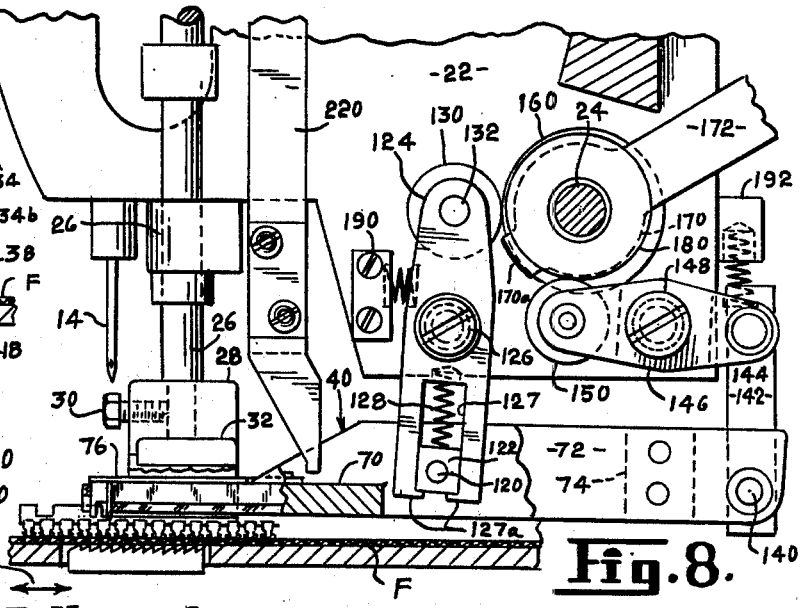

FIG. **8*a* is a front view of FIG. 8** showing the feed and cutter blades elevated above the fastener elements.

Figure 2:
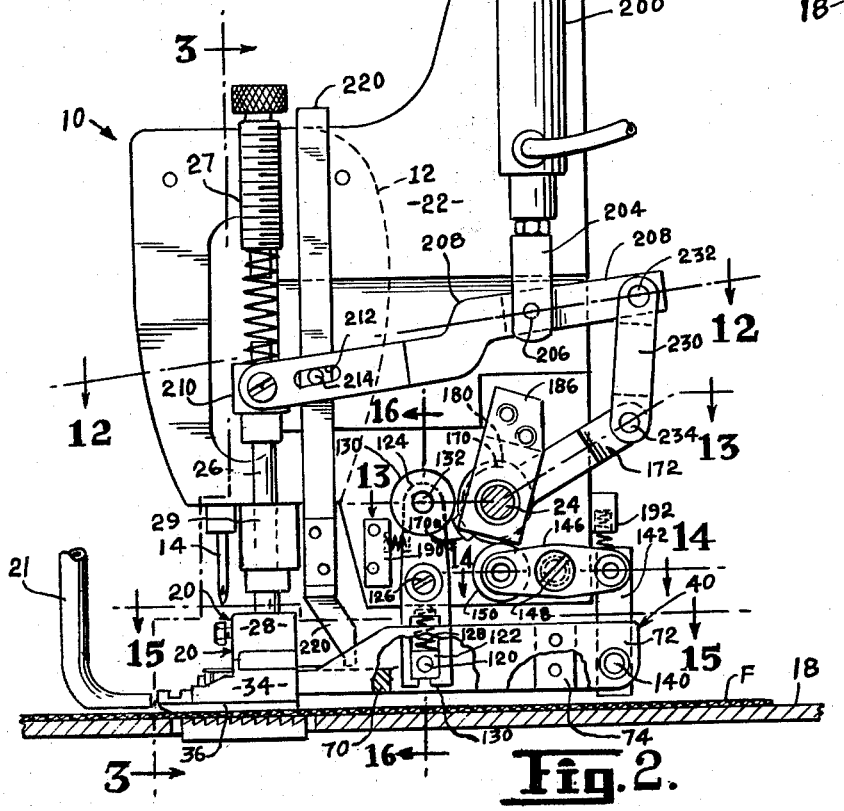
FIG. 2 is a sectional view taken on the line 2—2 of FIG. 1.
Figure 4:
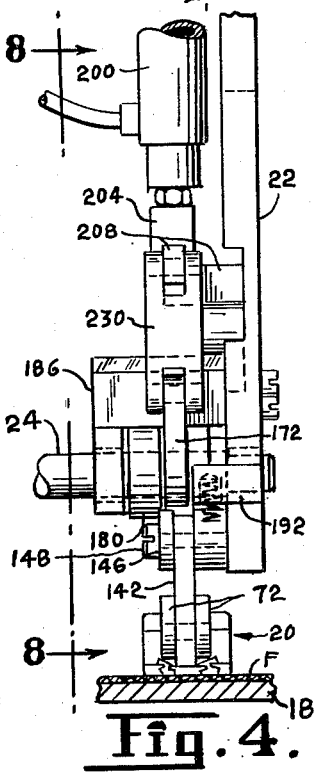
FIG. 4 is a rear view with the cylinder and the upper part of the end plate of the machine broken away to save drawing space.
Figure 6:
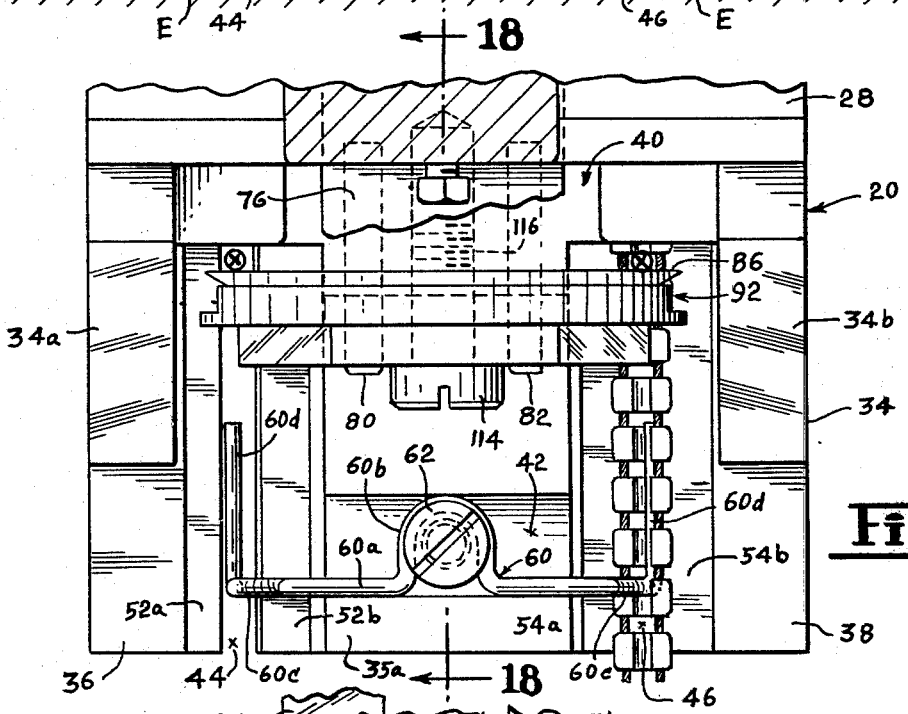
FIG. 6 is a sectional view taken on the line 6—6 of FIG. 5.
Figure 11:
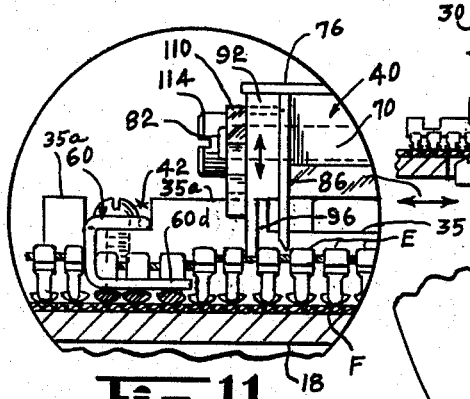
Figure 9:
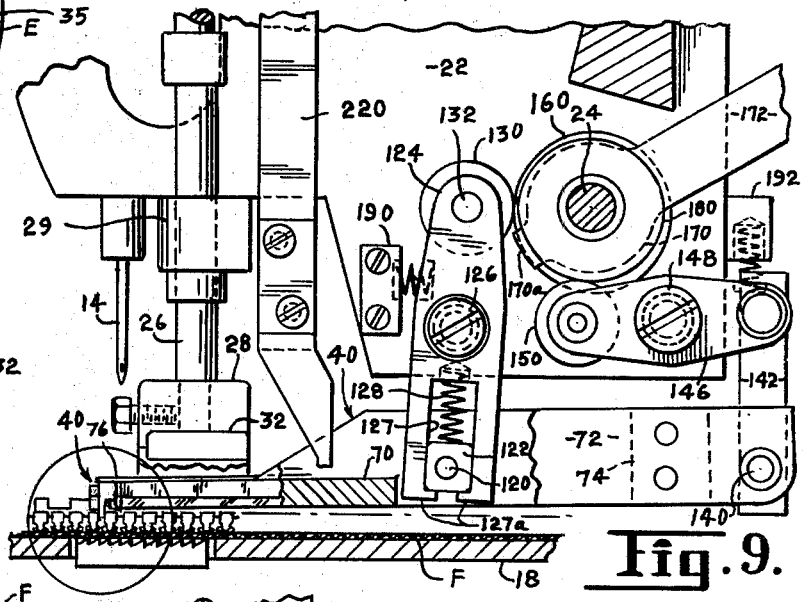
Figure 10A:
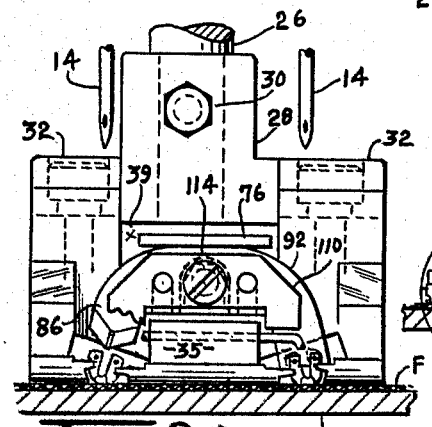
Figure 10A:
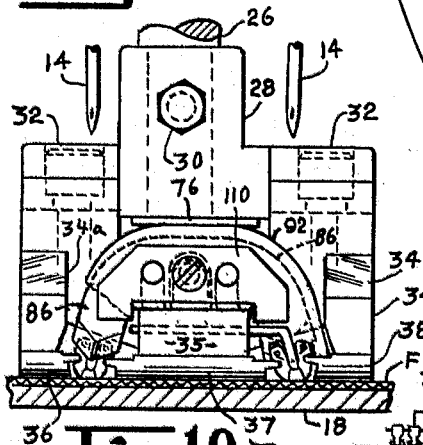
Figure 10:
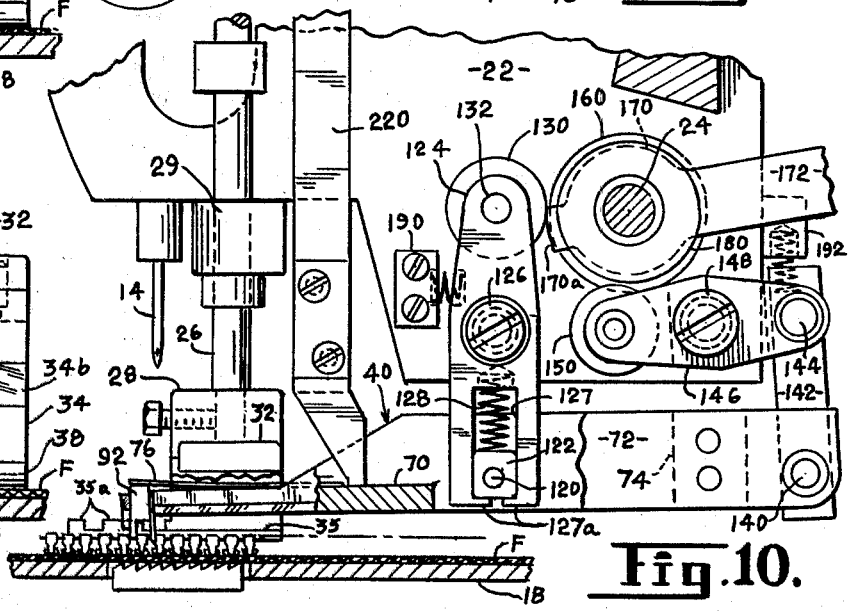
Figure 12:
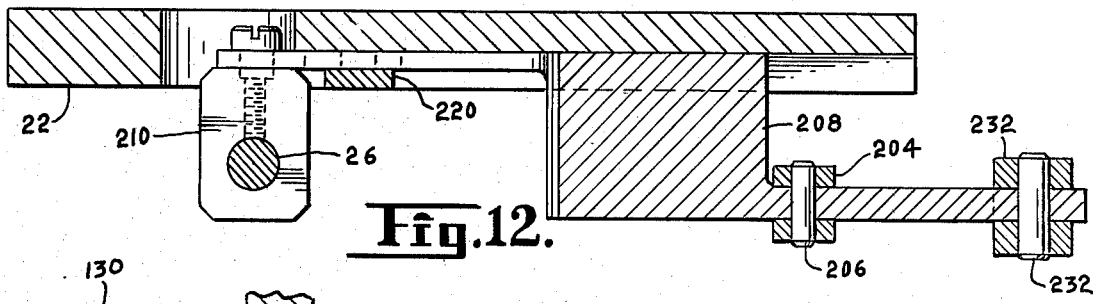
Figure 16:
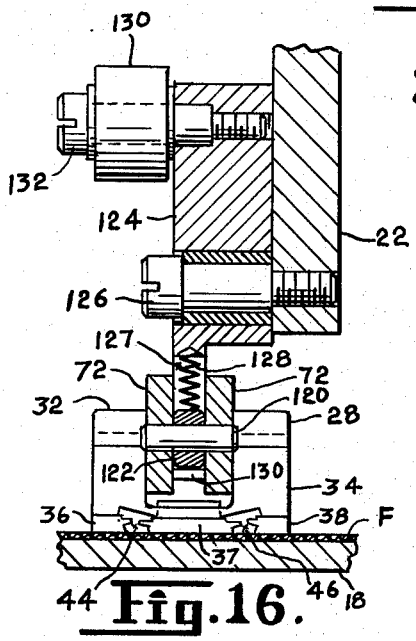
Figure 13:
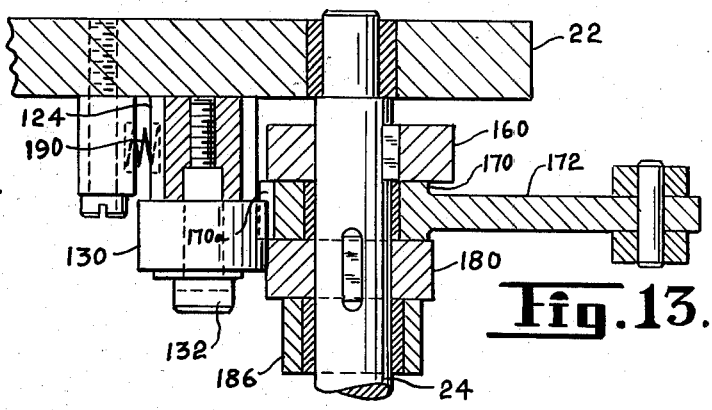
Figure 14:
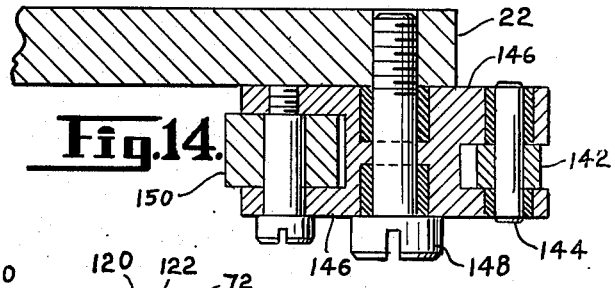
Figure 15:
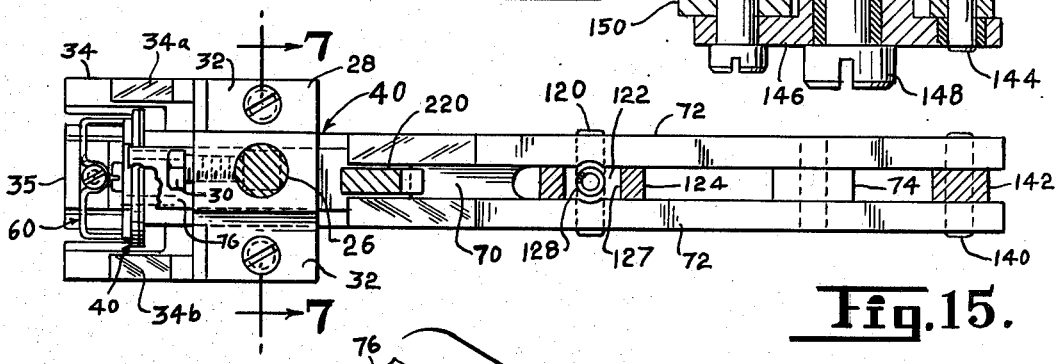
Figure 17:
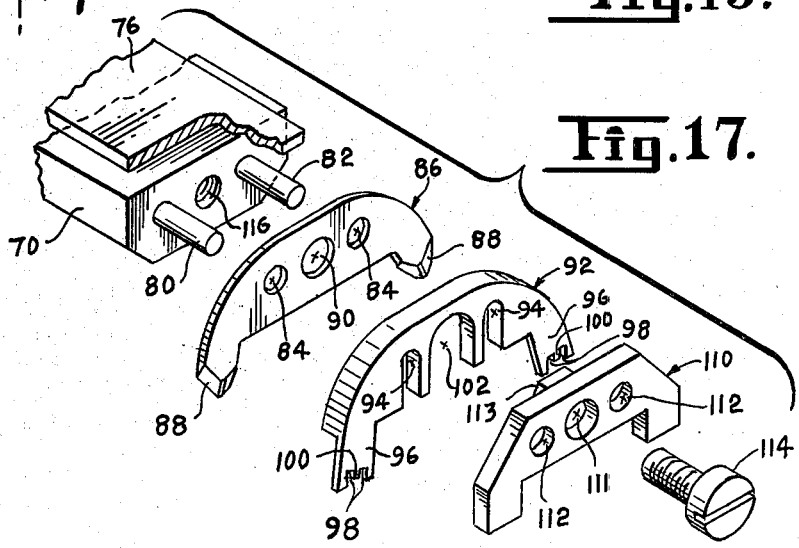
Figure 18:
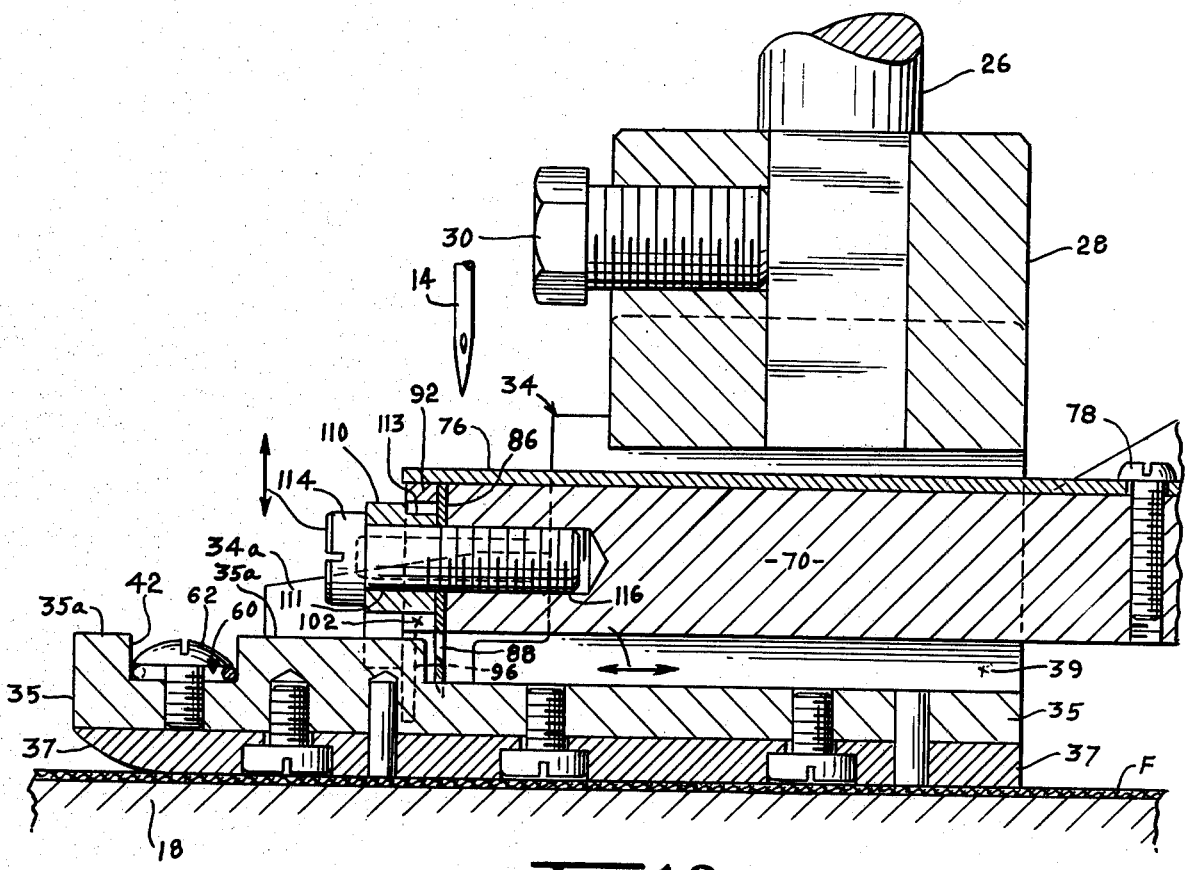

FIG. 9 is a view similar to FIG. 8 but showing the feed and cutter assembly with its front end downward to engage fastener in the line;

FIG. **9*a* is a view similar to FIG. 8*a*** but showing the engaging blade engaging the line. The left portion of the feed blade is broken away to show the cutting blade;

FIG. 10 is comparable to FIGS. 8 and 9 but shows the feed and cutting assembly drawn rearward to the end of its stroke and the depressor bar pushing the front end of the feed and cutter assembly downward to sever the connecting cords of the fastener elements;

FIG. **10*a* is comparable to FIG. 9*a*** but showing the cutter blade actually cutting the line of fastener elements;

FIG. 11 is a greatly enlarged view of the encircled portion of FIG. 9 showing the feed blade engaging one of the fastener elements in a line of fastener elements;

FIG. 12 is an enlarged sectional view taken on the line 12—12 of FIG. 2;

FIG. 13 is a greatly enlarged fragmentary sectional view taken on the line 13—13 of FIG. 2;

FIG. 14 is an enlarged fragmentary sectional view taken on the line 14—14 of FIG. 2;

FIG. 15 is an enlarged sectional view taken on the line 15—15 of FIG. 2;

FIG. 16 is a sectional view taken on the line 16—16 of FIG. 2;

FIG. 17 is an enlarged fragmentary exploded view in perspective of the front end of the feed and cutter assembly;

FIG. 18 is a sectional view taken on the line 18—18 of FIG. 6; and

Figure 19:
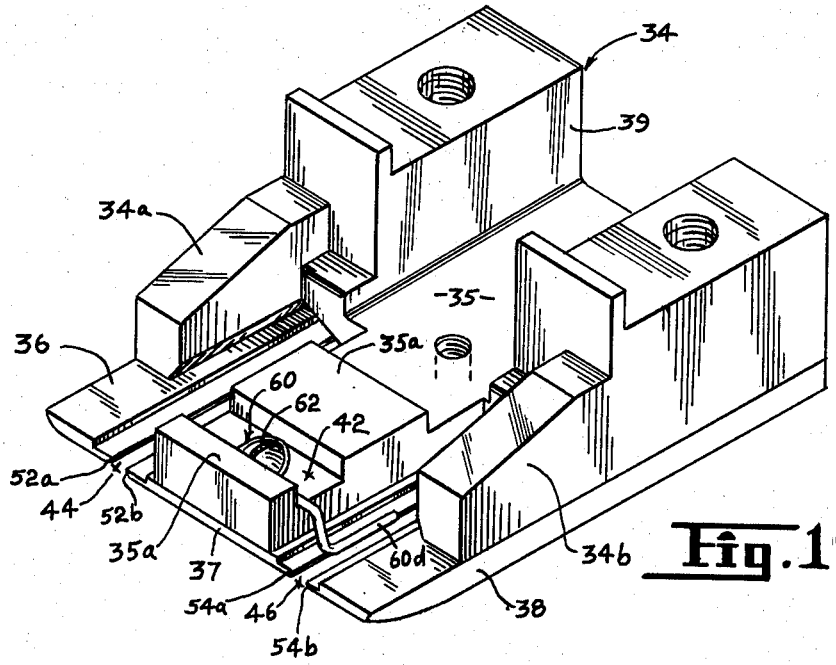

FIG. 19 is a perspective view of the sewing foot with the feed and cutter assembly and mounting block removed.

DESCRIPTION OF THE PREFERRED EMBODIMENT

To assist in understanding the apparatus of the invention, the structure of the fastener elements with which the apparatus of the invention is useful will first be explained. The slide fastener involved comprises two ladders or lines of interfitting fastener elements, a representative element of which is designated generally E in FIG. A. It comprises legs L joined by a central bight B having an enlarged head H. The outer portions of the legs are formed with notches N for reasons which will appear. The individual elements are held in uniform spaced relation by a pair of connecting cords C buried respectively in the ends of the legs. A strip of this general description is covered by U.S. Pat. No. 3,414,948.

Figure 1:
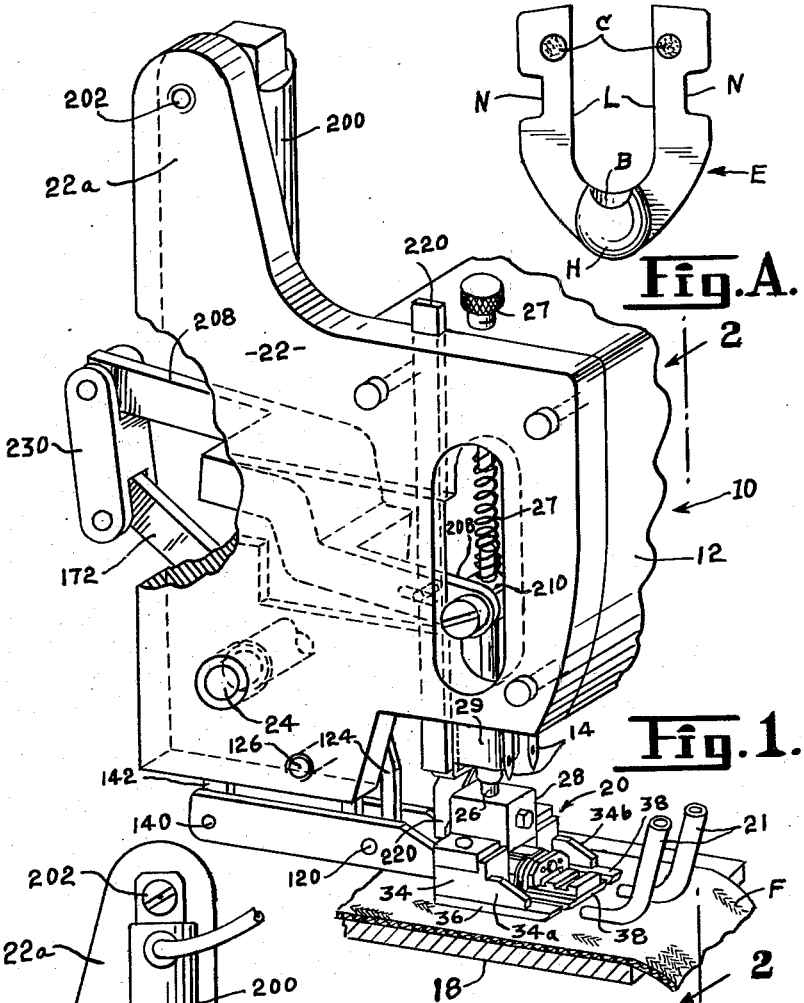
FIG. 1 is a perspective view of an attachment embodying the invention attached to a conventional sewing machine.

An apparatus embodying the invention is generally designated 10 in FIG. 1. It comprises a conventional industrial sewing machine 12 having needles 14 at the lower end of needle bars (not shown). A bed or support platform 18 is provided under which are disposed the conventional mechanism including the bobbin assembly and means to interconnect the bobbin and main threads and feed the fabric as the sewing progresses.

A special foot 20 is provided which holds down the fabric F being worked on against the bed or platform 18. Strip feed tubes 21 supported by means not shown deliver strips to the foot.

Figure 3:
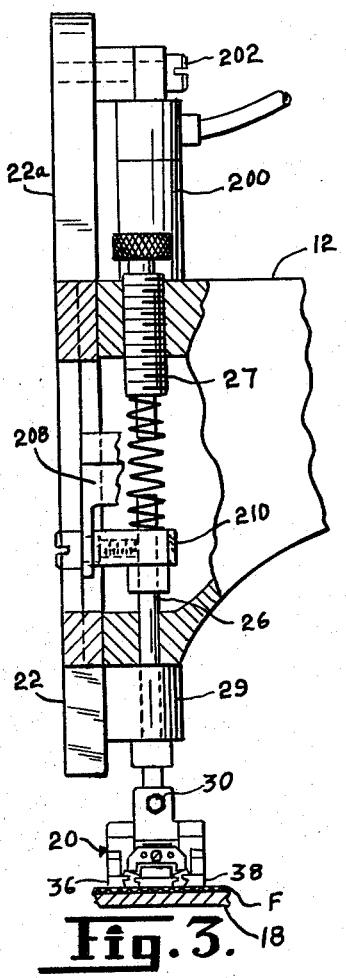
FIG. 3 is a sectional view taken on the line 3—3 of FIG. 2.

Under the invention, the conventional end of the sewing machine 12 is replaced by special end plate 22 secured as by bolts to the frame of the sewing machine. The end plate 22 has an upward projection 22*a*. An end of a drive shaft 24 is journaled in the plate for rotation. The shaft 24 is driven by the motor of the sewing machine so that its rotation is in timed relation to the reciprocation of the needles 14. The foot 20 is mounted on the lower end of a foot shaft 26 (FIG. 3) urged down by adjustable spring means 27 and held for vertical reciprocation within the bearing 29 is conventional fashion. It is operated by the sewing machine upon actuation of controls, not shown. It is shown in the down position in FIG. 2 but may rise on actuation to permit passage of the fabric without interference.

THE SEWING FOOT

Figure 5:
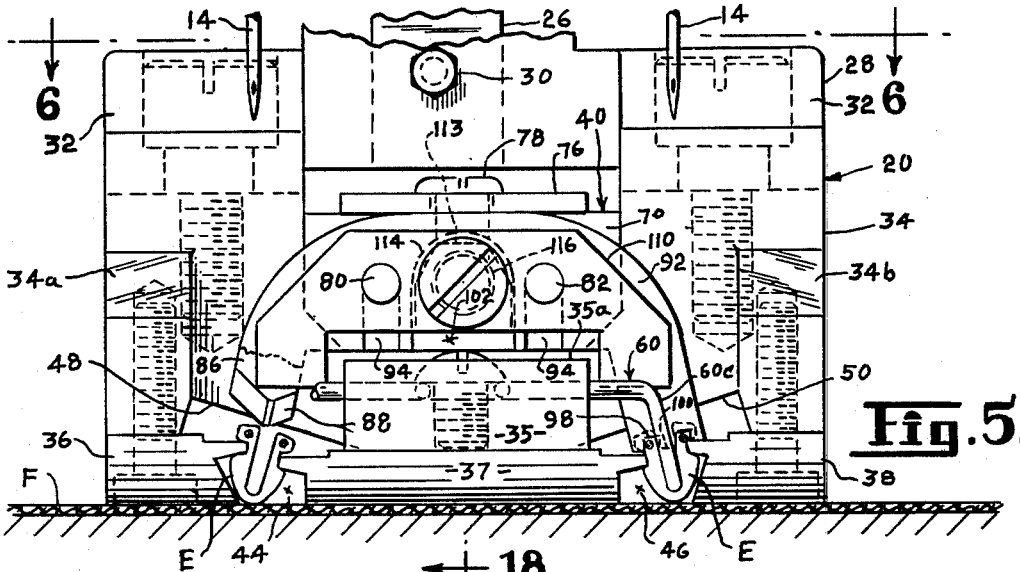
FIG. 5 is a greatly enlarged front view of the sewing station of the machine.
Figure 7:
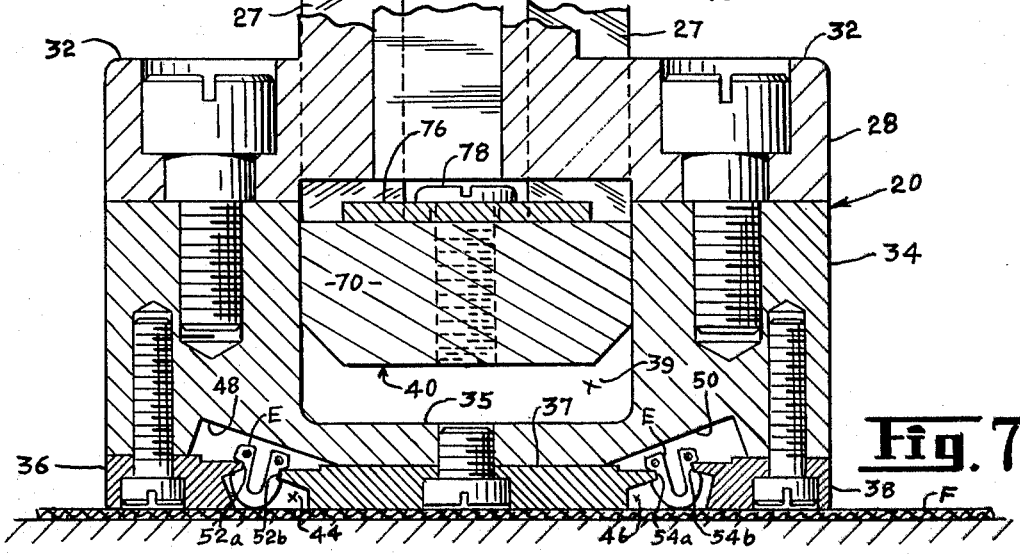
FIG. 7 is a greatly enlarged sectional view taken on the line 7—7 of FIG. 15.

Referring more specifically to the foot 20, it comprises a mounting block 28 of inverted "T" shape (FIG. 5). The block 28 is vertically apertured to receive the bottom of the foot shaft 26 and a set screw 30 is provided to hold the two in proper relation. Secured by bolts to the opposite side of the outward flanges 32 of the block 28 is the inverted channel block 34 which supports bottom plates 36, 37, 38. This structure provides an opening 39 which permits the passage of the head of a feed and cutter assembly 40 (FIG. 7).

As shown in FIGS. 1, 18 and 19, the sides of the forward end of the channel element 34 are formed with tapered forward wings 34*a* and 34*b*. These wings help support the outer bottom plates or runners 36 and 38 (FIGS. 5, 6, and 7). A central runner plate 37 as well as the outer plates are secured by bolts as shown to the inverted channel block 34. The central portion 35 (FIGS. 18 and 19) of the inverted channel block 34 extends forward, is raised as at 35*a* and is stepped downward to present a notch 42 (FIG. 6) running transverse thereof.

As best shown in FIGS. 6 and 19), the side bottom plates 36 and 38 are spaced from the central bottom plate 37 to provide channels 44 and 46, respectively. As shown, the inverted channel block 34 (FIG. 7) is notched out at 48 and 50 in line with the channels 44 and 46 for clearance purposes. The channels 44 and 46 are each defined by a pair of offset flanges 52*a* and 52*b* and 54*a* and 54*b*, respectively, which engage in notches N (FIG. A) of the individual slide fastener element to help support them as they travel through the foot 20.

The lines of fasteners are additionally supported by a wire guide 60 (FIGS. 5, 6) which is of generally "U" shape, having a central bight 60*a* with a bend 60*b* engaged by the head of a bolt 62 to hold it in the notch 42 on the channel block. The guide at the ends of the bight turns downward as at 60*c* into the channels 44 and 46 and terminates in rearward runs 60*d* which are disposed between the flanges 52*a* and 52*b*, and 54*a* and 54*b*, respectively.

As the lines of slide fastener elements move through the foot 20, the wire guide 60 serves to assure that the "U"-shaped elements are sufficiently spread and properly angled as they approach the sewing station (see X in FIG. 6). The rear ends of the run 60*d* serve as a kind of ratchet effect to avoid any forward movement of the lines of fastener elements as the feed and cutter assembly moves forward.

FEED AND CUTTER ASSEMBLY

Referring more specifically to the feed and cutter assembly 40, its forward end includes base plate 70. Base plate 70 is supported above the bottom of the central section or web of the inverted channel block. To the rear end of the base plate 70 are secured a pair of vertically disposed side plates 72 (FIG. 8) held in spaced relation by a spacer element 74. The forward ends of the side plates 72 are tapered, as shown in FIG. 8, where they are integral with the base plate 70. A spring strip 76 overlies the base plate 70 and has its rearward end secured thereto by a bolt 78 (FIG. 7). Its forward end extends beyond the end of the plate 70.

The front end of plate 70 is provided with a pair of spaced pins 80, 82 (FIGS. 6, 17) which extend forwardly as shown. The pins are received into ample openings 84 in a flat inverted "U"-shaped cutter element 86 having a downward "V"-shaped cutter 88 on either end thereof. Note central aperture 90. The line feed plate 92 is similarly flat and inverted "U"-shaped and is formed with a pair of downward-facing notches 94, the plate being thinned at either of its lower ends at 96 and shaped at the downward ends with cut-outs 98, each cut-out having a central tongue 100. Note central aperture 102.

A clamp plate 110, also of inverted "U" shape, is provided with central opening 111 and apertures 112 (FIG. 17) which receive the ends of the pins 80, 82 after they pass through the openings 84, 94 in the cutter and feed plates. The plate 110 has a rearward spacer 113 about opening 111. A bolt 114 extends through central openings 111, 102, and 90 and fits into tapped opening 116 in the base plate 70 to hold the assembly together. Spacer 113 tightly engages cutter plate 86 (FIG. 18), but because it is thicker than feed plate 92, permits feed plate 92 to move vertically with respect to the spacer.

As best shown in FIG. 5, the feed plate 92 is normally held with the upper end of the notches 94 against the pins 80, 82 but the spring strip 76 yields upon upward force on the feed plate to permit the feed plate, after bottoming on surface 35*a* (FIG. 10), to move upwardly with respect to the pins 80, 82. Cutter plate 86, as explained, is held rigidly with respect to the base plate 70.

FEED AND CUTTER ASSEMBLY DRIVE MEANS

As disclosed, the feed element 40 comprises the two elongate elements 72 spaced by spacing means 74. A pin 120 extends between the elements 72 and is journaled in a collar 122 having a central opening and flat sides.

A support arm 124 (FIG. 8) is pivoted to the sewing machine end plate 22 by a pin 126 passing through a boss intermediate the ends of the arm 124. The lower end of the arm 124 is formed with an elongated slot 127 which receives the collar 122. A sspring 128 presses the collar 122 downward. The lower end of the slot 127 is formed with inward fingers 127*a* which provide stop means for the lower end of travel of the collar 122 in the slot 127.

The feed and cutter assembly 40 is thus supported, floating fashion, on the arm 124, the collar 122 being permitted substantial vertical sliding movement in the slot 127. The upper end of the arm 124 is formed with a follower wheel 130 rotatably mounted on a pin 132. As shown in FIG. 13, the wheel 130 is well out from plate 22.

The rearward end of the feed and cutter assembly 40 is provided with a pin 140 which extends between the spaced side elements 72. Intermediate these elements, the pin is received into an opening in a link 142, the upper end of which is pivotally attached by a pin 144 to a kind of walking beam 146 pivotally attached to the plate 22 by a bolt 148 rigidly mounting thereon. The other end of the beam carries a second follower wheel 150.

As disclosed, the shaft 24 rotates in a bearing mounted in the end plate 22. Inward of the plate, the shaft 24 (FIG. 13) has rigidly mounted thereon a first peripheral cam 160 which regularly engages the wheel 150 and as the shaft 24 rotates, causes the wheel 150 to move up and down. This in turn causes an oscillating movement of the walking beam 146, the motion of the rear end of which is communicated by the line 142 to the rearward end of the feed and cutter assembly 40. As the rearward end moves up and down, the foreward end bearing the feed and cutter blades moves down and up correspondingly (FIG. 8).

Inward of the cam 160, the shaft 24 loosely mounts an override cam 170 (FIG. 13) which is formed with a nose 170*a*. The cam has an integral rearwardly extending arm 172 by which the override cam 170 can be rotated even while the shaft 24 is rotating itself. Further inward from the override cam 170, the shaft 24 rigidly mounts a second peripheral cam 180. This cam engages the follower 130 (FIG. 13) and moves it forward and rearward (FIG. 2) which motion is reflected in a corresponding rearward and forward motion of the lower end of the arm 124. This produces similar movements of the feed and cutter assembly 40. Still further inward, the shaft 24 is supported by a bearing plate 186 which helps steady the shaft in its rotation. Inward of the bearing plate 186, the shaft 24 is driven by means not shown.

As a result of the structure shown in FIGS. 13, 2, the continuous rotation of the shaft 24 results in a movement of the forward end of the feed and cutter assembly 40 which generally follows a square or rectangular path proceeding in a counterclockwise sense in the FIG. 2 view. It will, incidentally, be noted that the upper portion of the arm 124 is biased rightwardly (FIG. 8) by the spring unit 190 and that the rear end of the walking beam 146 is biased downwardly by the spring unit 192 to insure engagement of the followers with the respective arms at all times.

The result of the rectangular movement of the front and of the feed and cutter assembly 40 can best be understood by referring to FIG. 11. The working end 96 of the feed element 92 will, as the motion of the assembly is achieved, repeatedly engage between successive elements E and move them rightwardly one element's pitch. the result is that one complete turn of the shaft 24 results in the rightward stepping of the line of slide fasteners by the pitch of one element. As this movement is repeated again and again, the lines of slide fastener elements are moved together through the sewing foot and the lines are held in such a position in the channels 44 and 46 by the defining flanges 52*a*, 52*b* and 54*a*, 54*b* as well as the wire element 60, that the needles 14 (FIG. 1) in their normal stroking sew each successive element to the fabric F.

CUT-OFF ACTION

As well shown in FIG. 2, a cylinder piston unit 200 has its upper end pivotally attached by a pin 202 to the upper end 22*a* of the plate 22. The downward piston shaft from the unit 200 is attached to a clevis 204 which carries a pin 206 engaging the link 208 intermediate its ends by the pivot pin 206. The forward end of the link 208 is attached to a collar 210 on the upper end of the presser foot shaft 26. A cutter element depressor bar 220 is mounted in the plate 22 and extends downward to adjacent the bed plate 70. As shown in FIG. 2, towards its left end the link 208 is slotted longitudinally as at 212. A transverse pin 214 mounted rigidly on the depressor bar 220 is disposed in the slot 212. Pivotally attached to the rear end of the link 208 is a second link 230 as by a pin 232. The lower end of the link 230 is pivotally attached as by a pin 234 to the arm 172 of the override cam 170.

As shown in FIGS. 9 and 10, the lower of the arm 172 causes the nose 170*a* to engage the follower 130 to override the cam 80 (FIG. 13) and spring unit 190 to cause the follower 130 to move leftwardly irrespective of the position of cam 180. This, of course, causes the full retraction or rightward movement (FIG. 2) of the feed and cutter assembly 40.

In operation, the lowering of the arm 172, as shown in FIGS. 8, 9 and 10, is accomplished by the lowering of the clevis 204 (FIG. 2) by the piston cylinder assembly 200 actuated by means not shown. The lowering of the clevis 204, of course, lowers the rightward end of the link 208. Simultaneously, the lowering of link 208 through the pin 214 causes the depressing of the depressor bar 220. This causes the engagement of the lower pointed end of the depressor bar 220 with the bed plate 70 (compare FIGS. 9 and 10). It is seen that doing this during this time, because of the override nose 170*a* engaging the follower 130, the feed and cut-off element 40 is immobilized from horizontal reciprocation even though the needles 14 and feed means 17 of the sewing machine may continue to operate.

The depressing of the bed plate 70 by bar 220 moves the front end of the assembly 40 down. Because as they lower, the ends 96 of the feed plate 92 engage the connecting threads C. The further lowering of the front end of the assembly 40 causes plate 92 to bottom out on surface 35*a* (FIG. 10), slide up on pins 80, 82 forcing spring plate 76 to yield. As the front end goes lower, the cutter blade 86 cuts the cords C between two elements.

It should be noted that even with the depressor bar 220 down, foot 20 may be raised as the collar 210 and forward end of link 208 raise with the foot.

It should be clear that the control of the apparatus of the invention may be by means of solid state devices as described in the above-mentioned Foults patent. Such devices can be selectively programmed to control the length of the zipper, length of pre-zipper and post-zipper anchoring stitches, etc.

The apparatus of the invention produces a reliable means to attach slide fastener strips directly to the fabric of a garment or the like. It is important to understand that there is substantial demand for such means.

It will be clear that the apparatus falling under the invention may take many forms. Therefore, the coverage should be limited only by the following claim language or equivalents thereof:

I claim:

1. An apparatus for sewing a ladder of slide fastener elements directly to the fabric of a garment or the like, the ladder comprising plastic U-shaped fastener elements each comprising a pair of legs and a central bight, the elements being connected and held in spaced relation by a plurality of connecting cords at least one of which is embedded in each of the legs of the successive elements, the apparatus comprising:

(a) a sewing machine having a vertically reciprocating needle adapted to engage work at a sewing station and a work-supporting platform above which a needle reciprocates;

(b) a pressing foot adapted to guide and present the fabric and the ladder in the desired relation to the needle at the sewing station;

(c) a feed blade and cutter blade assembly including a feed blade and a cutter blade, a base member and means attaching the cutter blade rigidly thereto adjacent the pressing foot and means attaching the feed blade resiliently to the base member and generally aligned with and parallel to the cutter blade;

(d) drive means for driving the feed blade and cutter blade and a portion of the base member thereadjacent in an up-and-down and back-and-forth rectangular pattern of motion so that the feed blade engages successive fastener elements and moves the ladder step-by-step fashion to the sewing station; and (e) means for momentarily restricting the back-and-forth movement of the base member thereby terminating the feed, and for depressing the base member adjacent the blades below the usual lower limit of up-and-down travel so that the feed blade yields as its engages the connecting cords but the cutter blade moves downward and severs the connecting cords.

2. An apparatus as claimed in claim 1 wherein the drive means comprises a pair of followers associated with the base member, one of the followers controlling the back-and-forth movement, the other controlling the up-and-down movement, and cam means are provided and driven in timed relation to the sewing machine.

3. An apparatus as claimed in claim 2 wherein the means for momentarily restricting the back-and-forth movement of the base member comprises override means adapted to override the action of the cam means against the follower controlling the back-and-forth movement.

4. An apparatus as claimed in claim 3 wherein the override means and the depressor means are driven simultaneously by pneumatic means.

5. An apparatus as claimed in claim 3 wherein the override means is a lever pivotally mounted on the cam shaft and adapted when in the override position to move the said one follower away from the cam means.

6. An apparatus as claimed in claim 1 wherein the feed blade and cutter blade are parallel and mounted on pins extending forward from the base member, the feed member receiving the pins through ample openings and a spring member extends from the top of the base member to urge down the feed blade on its mounting on the pins but yielding to permit upward movement of the feed blade on the pins when the feed blade is urged up with respect to the base member.

7. An apparatus as claimed in claim 1 wherein the pressing foot includes track means adapted to engage the opposite sides of the fastener elements, and wire means to engage the U-shaped element from the inside.

8. An apparatus for sewing a ladder of slide fastener elements directly to the fabric of a garment or the like, the ladder comprising plastic U-shaped fastener elements each comprising a pair of legs and a central bight, the elements being connected and held in spaced relation by a pair of connecting cords embedded respectively in the legs of the successive elements, the apparatus comprising:

(a) a sewing machine having a vertically reciprocating needle adapted to engage work at a sewing station and a work-supporting platform above which a needle reciprocates;

(b) a pressing foot adapted to guide and present the fabric and the ladder in the desired relation to the needle at the sewing station; the pressing foot having an opening therethrough extending in a direction parallel to the sewing line;

(c) a feed and cutter assembly adapted to move the ladder to the sewing station and cut the ladder when desired and comprising a feed blade and a cutter blade and a generally horizontal elongate element having a forward end extending through the opening and mounting the feed blade and the cutter blade on the front end thereof, the cutter blade being rigidly mounted and the feed blade being resiliently mounted, the blades both being downwardly directed, spaced and parallel;

(d) a pair of arms pivotally attached to the sewing machine and supporting the elongate element, the arms each having a cam follower associated therewith, the first arm and associated first follower adapted to move the elongate element in a back-and-forth movement and the second arm and associated second follower adapted to move the front end of the elongate element in an up-and-down motion;

(e) rotary cam means driven in timed relation to the sewing machine and adapted to be engaged by the two followers to produce the aforementioned movements.

9. An apparatus as claimed in claim 8 including means to override the cam means with respect to the first follower to still the back-and-forth movement of the elongate element.

10. An apparatus as claimed in claim 9 including additional means to depress the forward end of the elongate element whereby the cutter blade severs the connecting cords.

11. An apparatus as claimed in claim 10 wherein the override means and the depressor means are operated together by a single movement source.

12. An apparatus as claimed in claim 11 whereby the movement source is a pneumatic cylinder.

13. An apparatus for sewing a line of slide fastener elements directly to the fabric of a garment or the like, the line comprising a plurality of individual plastic fastener elements each comprising a body having a head, the elements being connected and held in spaced relation by a plurality of connecting cords running the length of the line and each being embedded in the successive elements at points remote from the heads thereof, the apparatus comprising:

(a) a sewing machine having a vertically reciprocating needle adapted to engage work at a sewing station and a work-supporting platform above which the needle reciprocates;

(b) a pressing foot adapted to guide and present the fabric and the line in the desired relation to the needle at the sewing station;

(c) a feed blade assembly including a feed blade, a base member and means attaching the feed blade to the base member;

(d) drive means for driving the feed blade and a portion of the base member thereadjacent in an up-and-down and back-and-forth repetitive pattern of motion so that the feed blade engages successive fastener elements and moves the line step-by-step fashion to the sewing station;

(e) a cutter blade spaced from the feed blade and supported above the connector threads for up-and-down reciprocation;

(f) means for causing the cutter blade to move down toward the platform at a selected time so that the cutter blade severs the connecting cords; and (g) means for interrupting the pattern of motion of the base member at the selected time so that the line is not moving at the time that the cutter blade moves down.

14. An apparatus for sewing a line of slide fastener elements directly to the fabric of a garment or the like, the line comprising plastic fastener elements each comprising a body having a head, the elements being connected and held in spaced relation by a plurality of connecting cords running the length of the line and each cord being embedded in the successive elements at points remote from the heads thereof, the apparatus comprising:

(a) a sewing machine having a vertically reciprocating needle adapted to engage work at a sewing station and a work-supporting platform above which the needle reciprocates;

(b) a pressing foot adapted to guide and present the fabric and the line in the desired relation to the needle at the sewing station;

(c) a feed blade and cutter blade assembly including a base member and means attaching the cutter blade rigidly thereto adjacent but independent of the pressing foot and means attaching the feed blade resiliently to the base member and generally aligned with and parallel to the cutter blade;

(d) drive and support means for driving the feed blade and cutter blade and a portion of the base member thereadjacent in an up-and-down and back-and-forth repetitive pattern of motion so that the feed blade engages successive fastener elements and moves the line step-by-step fashion to the sewing station; and (e) means for momentarily restricting the back-and-forth movement of the base member adjacent the blade thereby terminating the feed, and for depressing the base member adjacent the blades below the usual lower limit of up-and-down travel so that the feed blade yields as it engages the connector cords but the cutter blade moves downward and severs the connecting cords.

* * * * *